US005113675A

United States Patent [19]

Uyeda

[11] Patent Number: 5,113,675

[45] Date of Patent: May 19, 1992

[54] INTERMEDIATE DOOR LOCKING MECHANISM

[76] Inventor: Alan K. Uyeda, 8939 Gallatin Rd., #25, Pico Rivera, Calif. 90660

[21] Appl. No.: 638,056

[22] Filed: Jan. 7, 1991

[51] Int. Cl.[5] ..... E05B 13/10; E05B 47/06

[52] U.S. Cl. ..... 70/477; 70/153; 70/214; 70/279; 70/283; 70/478; 292/358; 292/359

[58] Field of Search ..... 70/153, 213–216, 70/224, 467, 283, 279, 277, 278, 473, 475, 477, 478, 483–485; 292/169.23, 358, 359

[56] References Cited

U.S. PATENT DOCUMENTS

| | | | |
|---|---|---|---|
| 934,702 | 9/1909 | Thomas | 292/358 |
| 1,246,383 | 11/1917 | Bertram et al. | 70/467 |
| 2,124,897 | 7/1938 | Shaw | 292/359 X |
| 2,316,493 | 4/1943 | Swarens et al. | 292/359 |
| 3,042,437 | 7/1962 | Duvall | 292/169.23 X |
| 4,148,092 | 4/1979 | Martin | 361/172 |
| 4,457,148 | 7/1984 | Johansson et al. | 70/278 |
| 4,665,727 | 5/1987 | Uyeda | 70/279 |
| 4,774,512 | 9/1988 | Jolidon et al. | 340/825.31 |
| 4,899,562 | 4/1990 | Gartner et al. | 70/277 |
| 4,936,122 | 6/1990 | Osada | 70/279 X |

FOREIGN PATENT DOCUMENTS

| | | | |
|---|---|---|---|
| 1391281 | 1/1965 | France | 292/169.16 |

*Primary Examiner*—Lloyd A. Gall

*Attorney, Agent, or Firm*—Poms, Smith, Lande & Rose

[57] ABSTRACT

An intermediate locking mechanism which is interposed between the existing door bolt works and the door knob of a standard key door lock, which can be unlocked by use of either a key or by entry of an electronic code, the mechanism includes the provision of an interconnecting means for interconnecting the door knob to the door bolt with which manipulation of the door knob withdraws the door bolt, a securing means for securing the interconnecting means to preclude its manipulation, an electrically operated means for unlocking the securing means by entry of an electronically entered combination code and a mechanical key operated means for unlocking the securing means by manipulation of a key. After entry of the combination code, the electrically operated means manipulates the securing means from a first normally locked position to a second position enabling unimpeded operation of the mechanism. Rotation of a key causes the mechanically operated means to disengage the securing means, also enabling unimpeded operation of the mechanism.

21 Claims, 3 Drawing Sheets

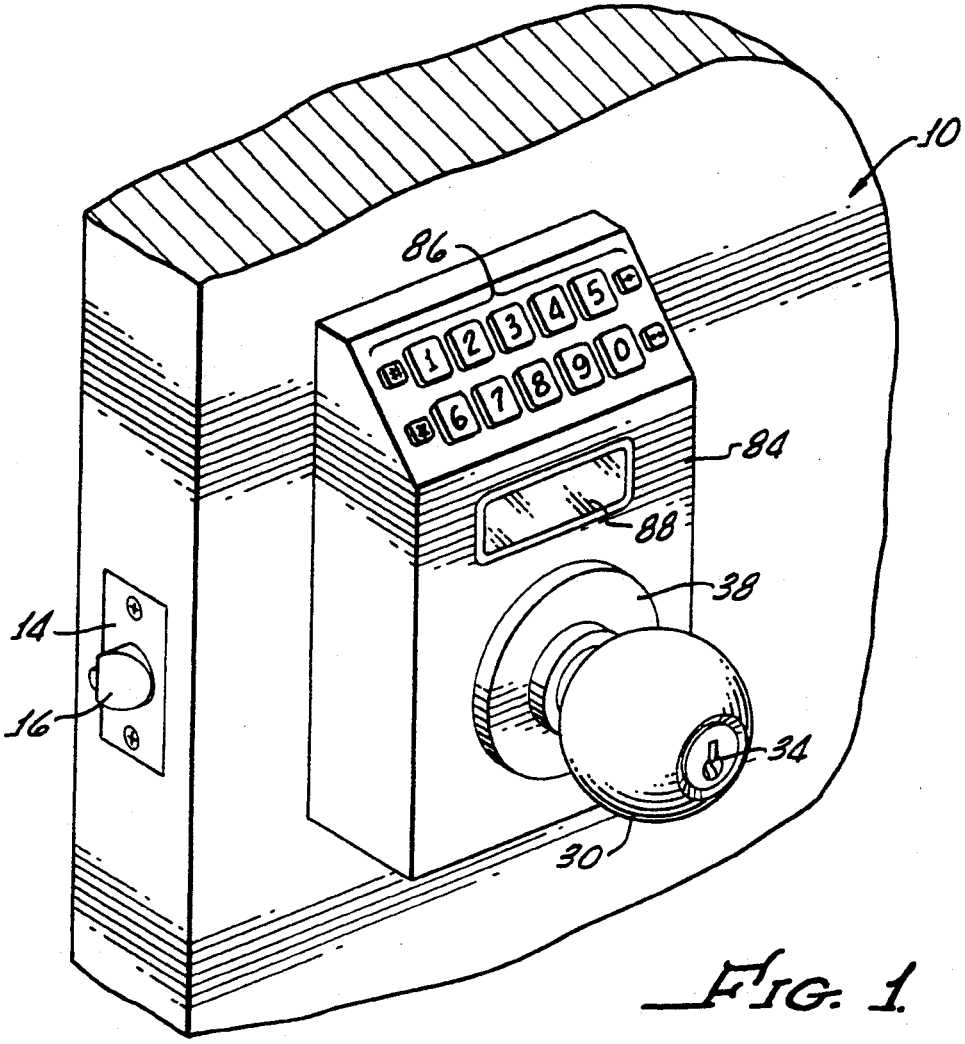
FIG. 1.
FIG. 8.
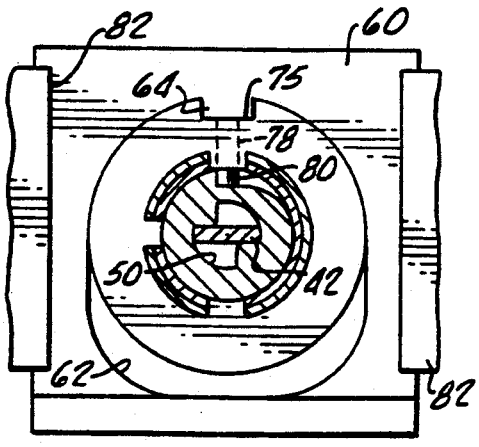
FIG. 7.
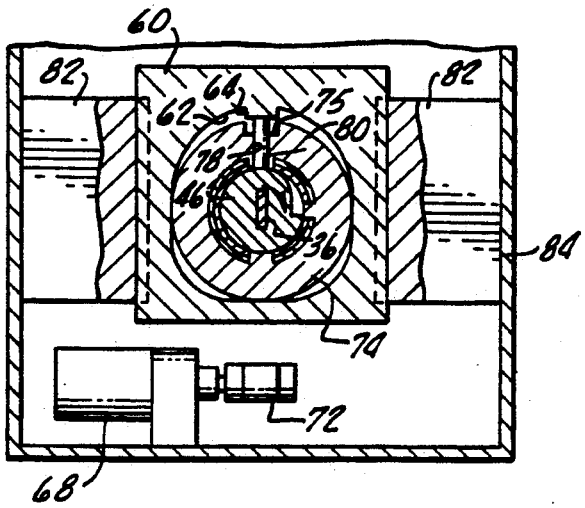

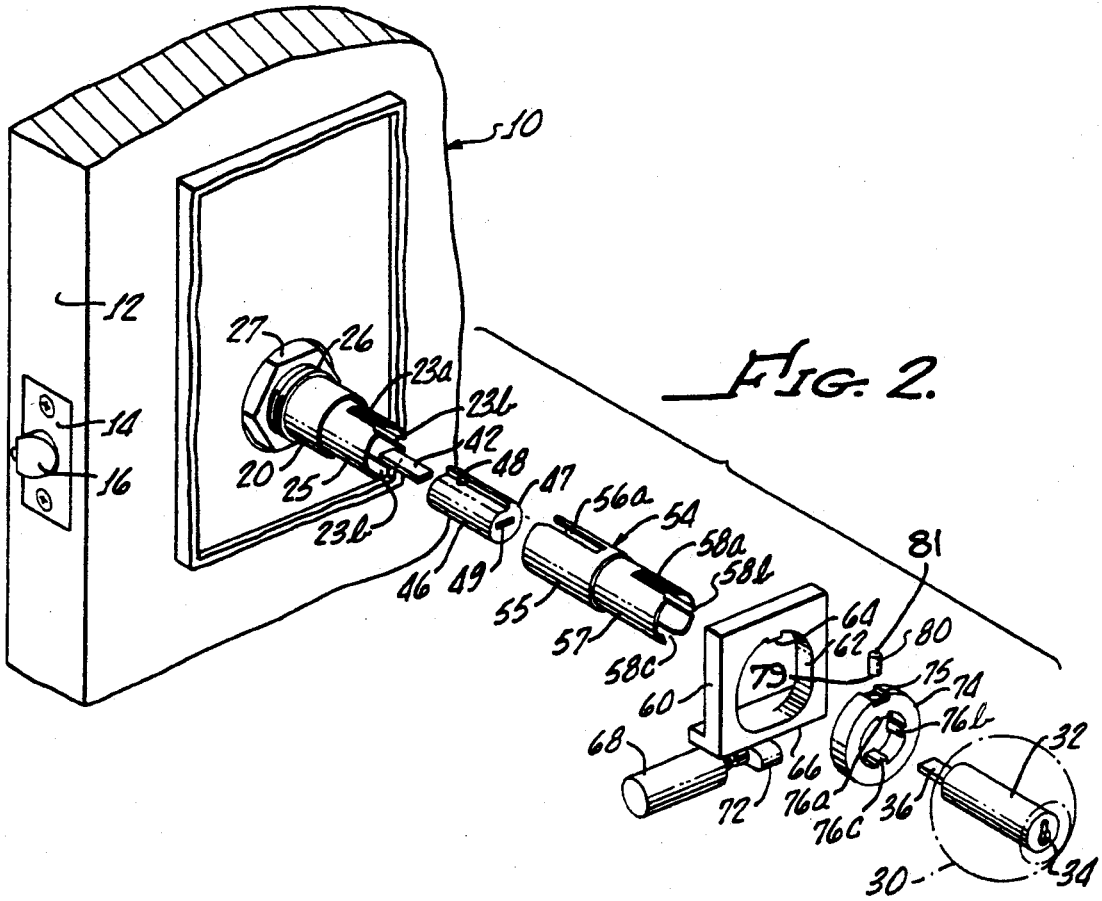
FIG. 2.
FIG. 3.
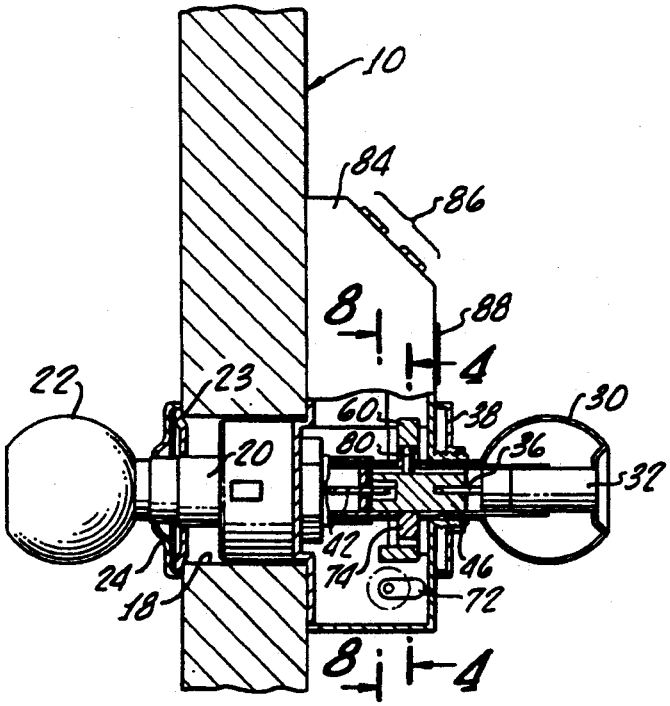
FIG. 4.
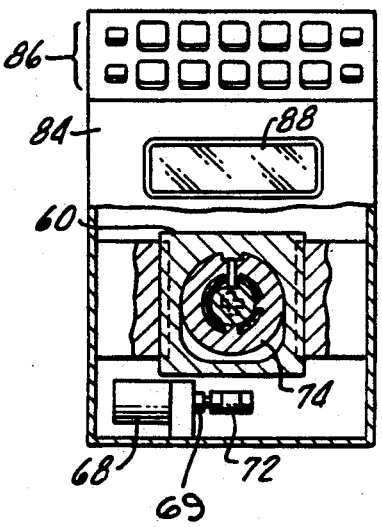

INTERMEDIATE DOOR LOCKING MECHANISM

INTRODUCTION

Generally stated, the present invention relates to door locks, and more particularly to an intermediate door locking mechanism which is unlockable by either a key or by entry of an electronic combination code.

BACKGROUND OF THE INVENTION

Key locks are frequently used in human passage doors for security. In these locks, rotation of a key turns a bolt works cylinder internal to the door, which in turn withdraws the door bolt against a spring bias, unlocking the door. Key locks offer the advantage of simplicity; they have only a few moving parts, and are very reliable. However, a user must have the correct key or the lock cannot be opened. If the key is lost or stolen, altering the lock to accept a different key requires that the entire lock cylinder be replaced.

Electronic door locks are also gaining in popularity. In the typical electronic door lock, the user enters a code, which generates a signal to a solenoid or other electronic means, which enables the bolt to be withdrawn. One such electronic door lock is disclosed by Gartner, U.S. Pat. No. 4,899,562. Electronic locks are also easy to use, and only require the user or remember the combination to gain entry. The combination can easily be shared, and can also be easily changed, increasing the convenience of the lock.

Accordingly, it would be most advantageous if the benefits of both key locks and electronic locks could be utilized in a single lock, wherein a door could be unlocked with either method. Further, it would be beneficial if an existing key lock could be simply retro-fitted with additional components to add the electronic lock, so that both locks use the same door bolt. It is anticipated that both business and home users of door locks would prefer the simplicity of a key lock with the convenience of an electronic lock.

SUMMARY OF THE INVENTION

It would be desirable to be able to modify a standard door key lock to include an electronic lock. It would also be desirable to be able to use the pre-existing bolt works and door knob provided on such doors. It would also be desirable to provide an electronic entry device to allow the user to enter a combination code.

It is therefore a primary object of the present invention to provide an intermediate locking mechanism for a conventional door, which is interposed between the bolt works cylinder and door knob. It is also an object of the present invention to provide a lock which can be opened by either a key or by entry of an electronic code. It is further an object of the present invention to provide an intermediate locking mechanism wherein an electronic keyboard entry device may be employed to enter a combination code.

Generally stated, the present invention includes the provision of an interconnecting means for interconnecting the door knob to the door bolt with which manipulation of the door knob withdraws the door bolt, a securing means for securing the interconnecting means to preclude its manipulation, an electrically operated means for unlocking the securing means by entry of an electronically entered combination code and a mechanical key operated means for unlocking the securing means by manipulation of a key. More specifically, the interconnecting means comprises a sleeve axially connecting the door knob to the door bolt, and a ring rigidly surrounding the sleeve having an external notch. The securing means comprises a movable locking plate having an oblong opening, a radially depending tooth normally positioned to engage the notch, and a contacting surface, the locking plate encompassing the ring within the oblong opening The electrically operated means comprises a data entry means for manually entering the combination code, and an actuator and associated cam adjacent to the contacting surface. The cam is rotatable in response to entry of the electronic code into the entry means to engage the contacting surface and manipulate the locking plate upwardly until the tooth has disengaged from the notch, enabling unimpeded rotation of the interconnecting means. The mechanically operated means comprises a lock cylinder internal to the door knob, and associated with a key, a camshaft within the sleeve and axially connected between the lock cylinder and the door bolt, a radial bore centered within the notch, and a pin movable within the radial bore, the camshaft having a cam surface, the pin contacting the cam surface and the tooth. Rotation of the key within the lock cylinder further rotates the camshaft which urges the pin upwardly relative the ring, until the tooth has disengaged from the notch, enabling unimpeded rotation of the interconnecting means.

A more complete understanding of the intermediate locking mechanism of the present invention will be afforded to those skilled the art, as well as a realization of additional advantages and objects thereof, by a consideration of the following detailed description of a preferred exemplary embodiment. Reference will be made to the appended sheets of drawings which will be first described briefly.

DESCRIPTION OF THE DRAWINGS

FIG. 1 is a perspective view of an exemplary door installation of a preferred embodiment of the intermediate locking mechanism of the present invention;

FIG. 2 is an exploded view of the exemplary intermediate looking mechanism;

FIG. 3 is a partial side view of the exemplary intermediate locking mechanism, showing the exemplary intermediate locking mechanism in the locked position;

FIG. 4 is a sectional view, partially cutaway, of the exemplary intermediate locking mechanism in the locked position, as revealed by the section 4—4 taken in FIG. 3;

FIG. 7 is a sectional view, as in FIG. 4, showing the intermediate locking mechanism in the unlocked position after use of the key; and FIG. 8 is a sectional view of the intermediate locking mechanism in the locked position, showing the lost motion connection with the door bolt, as revealed by the section 8—8 taken in FIG. 3.

DETAILED DESCRIPTION OF A PREFERRED EXEMPLARY EMBODIMENT

Figure 6:
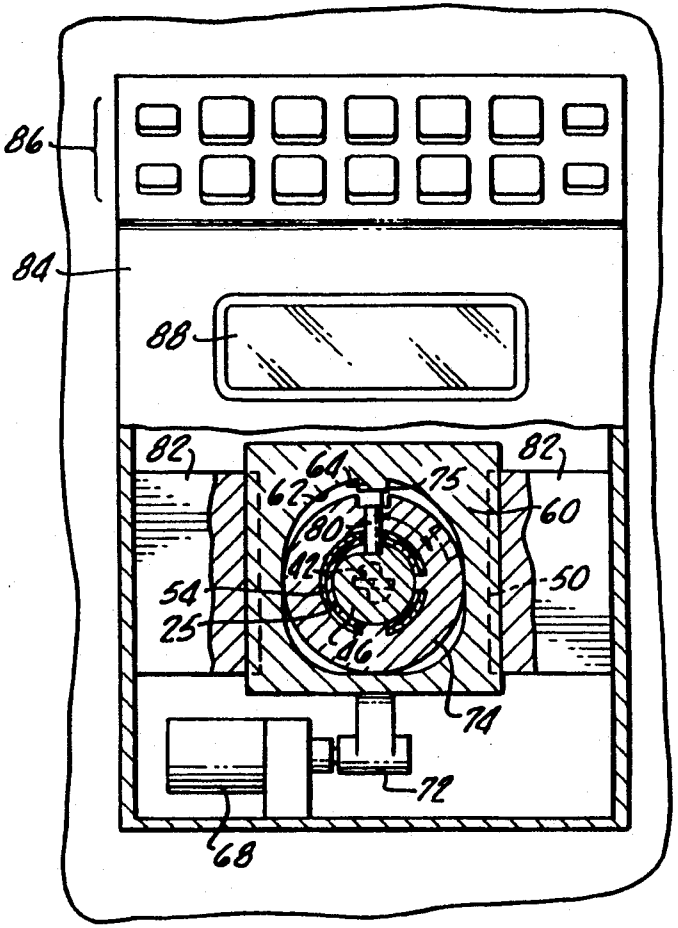
FIG. 6 is an enlarged sectional view, as in FIG. 4, showing the intermediate locking mechanism in the unlocked position after entry of the electronic code.

Referring first to FIG. 1, a preferred exemplary embodiment of an intermediate locking mechanism in accordance with the present invention is illustrated in association with a standard door 10, having a door knob 30 and a door bolt 16. The exemplary door bolt 16 is spring biased in a normally protruding position relative the edge portion 12 of door 10, and is enclosed within the door by bolt plate 14.

As is commonly known in the industry, a standard bolt works cylinder 20 is provided to actuate door bolt 16, as best shown in FIGS. 2 and 3. Clockwise rotation of cylinder 20 withdraws door bolt 16 against its bias Bolt works cylinder 20 is mounted within cavity 18 formed in the interior of door 10. On the front side of door 10, an end of cylinder 20 protrudes through face plate 28, and is held in place by nut 27 which threads onto threaded portion 26 of cylinder 20 Coupling portion 25 extends from the exposed end of cylinder 20, which connects to the intermediate locking means as will be described hereinbelow. On the opposite side of door 10, cylinder 20 protrudes through plate 23 and attaches to standard door knob 22. Vanity plate 24 is also provided to decoratively cover plate 23 and a portion of cylinder 20.

In ordinary usage, door knob 30 attaches to coupling portion 25, which has a plurality of slits 23*a, b,* and *c,* to fixedly engage slots within door knob 30. An internal slot 21 is provided within cylinder 20, as shown in FIG. 3. Internal to door knob 30 is lock cylinder 32, having an exposed keyhole 34. As is commonly found in the art, lock cylinder 32 has an axially connected forward tab 36. Upon insertion of a key into keyhole 34, rotational movement of the key is transferred to forward tab 36. The exemplary bolt works cylinder 20 is manipulated by either rotation of coupling portion 25 or by rotation of internal slot 21. Forward tab 36 would normally engage internal slot 21, so that manipulation of a key in keyhole 34 would directly enable the user to withdraw bolt 16. Rotation of door knob 30 normally translates directly to coupling portion 25, to also enable the user to withdraw bolt 16. However, in the present invention, an intermediate locking mechanism is interposed between the bolt works cylinder 20 and door knob 30, as shown generally at 40 of FIG. 2.

The intermediate locking mechanism, shown generally at 40 of FIG. 2, is assembled within a housing formed by face plate 28 and cover 84, shown in FIG. 1. Cover 84 mounts directly to raised mounting ridge 29 of FIG. 2. Door knob 30 protrudes through cover 84, and vanity plate 38 is provided to decoratively enclose the opening through the cover. Exposed on the upper part of cover 84 is a data entry means for manually entering the combination code, comprising a keyboard 86 and a display screen 88. Keyboard 86 comprises ten keys corresponding to digits 0 through 9, and four special character keys The small display screen 88 is positioned above the protruding door knob 30, which displays the information entered into keyboard 86. Upon manual entry of the desired code combination into keyboard 86, an electronic signal is generated by known electrical means, which unlocks the door, as will be described hereinbelow. It is anticipated that the special character keys be used for programming the combination code into the locking mechanism 40, for clearing the screen 88, or for diagnosing problems within the electrical portions of the mechanism, as commonly known in the art.

The intermediate locking mechanism 40 of the present invention includes an interconnecting means for interconnecting the door knob to the door bolt with which manipulation of the door knob withdraws the door bolt, a securing means for securing the interconnecting means to preclude its manipulation, an electrically operated means for unlocking the securing means by entry of an electronically entered combination code and a mechanical key operated means for unlocking the securing means by manipulation of a key.

More specifically, the interconnecting means further comprises a sleeve axially connecting the door knob to the door bolt, and a ring rigidly surrounding the sleeve and having an external notch. The exemplary sleeve 54, shown in FIG. 2 has a first portion 55 and a second portion 57. First portion 55 has a slightly larger diameter than second portion 57, and both first portion 55 and second portion 57 have three parallel slits, shown as 56*a, b* and *c,* and 58*a, b* and *c,* respectively. The slits of sleeve 54 correspond to slits 23*a, b* and *c* of coupling portion 25, and sleeve 54 roughly forms an extension of coupling portion 25. First portion 55 envelopes coupling portion 25, providing a connection to bolt works cylinder 20. The second portion 57 fixedly engages door knob 30 in place of coupling portion 25 described hereinabove, such that rotation of door knob 30 is directly translated through sleeve 54 to bolt works cylinder 20 to withdraw door bolt 16.

The exemplary ring 74 rigidly engages and surrounds first portion 55 of sleeve 54. As also shown in FIG. 2, ring 74 has a plurality of splines 76*a, b* and *c* along its interior surface, which protrude radially inward. The splines are positioned to fixedly engage slits 56*a, b* and *c* and slits 23*a, b* and *c.* The exterior surface of ring 74 has external notch 75.

The securing means further comprises a movable locking plate having an oblong opening, a radially depending tooth normally positioned to engage the notch, and a contacting surface, the locking plate encompassing the ring within the oblong opening. The exemplary locking plate 60 is generally rectangular, and has an oblong opening 62, a radially depending tooth 64 normally positioned to engage notch 75, and contacting surface 66 along its base. Guide rails 82 are provided on the inner portion of cover 84, best shown in FIGS. 7 and 8, which channel movement of locking plate 60 vertically from a first locked position to a second unlocked position. Oblong opening 62 is sized to fully encompass ring 74, and allow vertical movement of locking plate 60 around ring 74. With locking plate 60 in its normal position, tooth 64 fully engages notch 75 preventing rotation of the interconnecting means.

Figure 5:
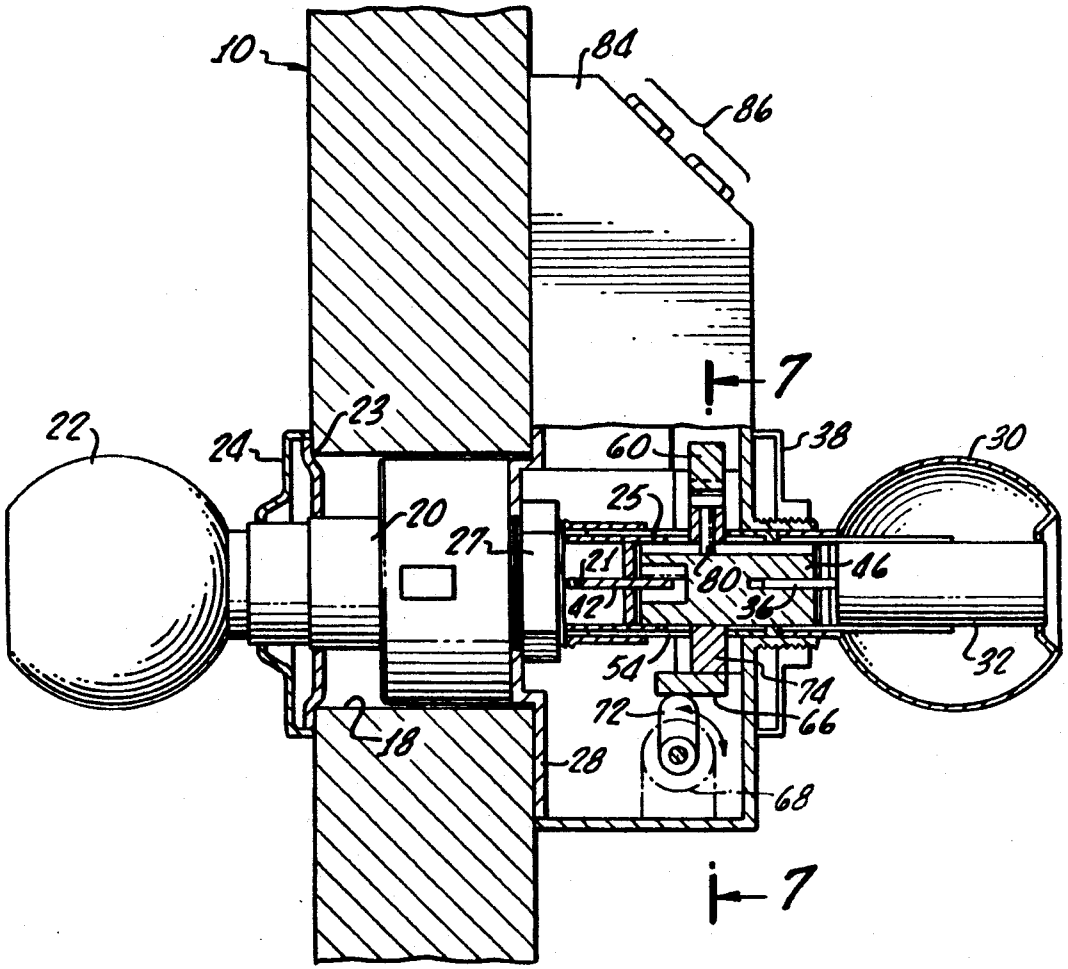
FIG. 5 is an enlarged side view, as in FIG. 3, showing the intermediate locking mechanism in the unlocked position after entry of the electronic code.

The electrically operated means further comprises a data entry means for manually entering the combination code, and an actuator and associated cam adjacent to the contacting surface, the cam being rotatable in response to entry of the electronic code into the entry means to engage the contacting surface and manipulate the locking plate until the tooth has disengaged from the notch, enabling unimpeded rotation of the interconnecting means. The exemplary contacting surface 66 is at the bottom of locking plate 60, and is adjacent to actuator 68 and associated cam 72. Cam 72 attaches to actuator 68 via actuator shaft 69, which is rotatable in response to an electronic signal, as will be described hereinbelow. Upon rotation of actuator shaft 69, cam 72 engages contacting surface 66 and manipulates locking plate 60 upwardly until tooth 64 has disengaged from notch 75, as shown in FIGS. 5 and 6. The interconnecting means is then free to be rotated to withdraw door bolt 16.

The mechanical key operated means further comprises a lock cylinder associated with a key internal to the door knob, and a camshaft within the sleeve axially connected between the lock cylinder and the door bolt, a pin having a first end and a second end, and a radial bore centered within said notch, said pin being movable within said radial bore, the camshaft having a cam surface, the first end of the pin contacting the cam surface and the second end of the pin contacting the tooth, whereby rotation of the key within the lock cylinder further causes rotation of the camshaft which urges the pin upwardly relative the ring, until the tooth has disengaged from the notch, enabling unimpeded rotation of the interconnecting means. The exemplary camshaft 46 axially connects between lock cylinder 32 and door bolt cylinder 20. It is generally cylindrical shaped, but has a varying radius which forms a cam surface 47 and stop surface 48 along its length. At the end facing door knob 30, an axial slot 49 is provided which mates with forward tab 36. The opposite end of camshaft 46 has lost motion connection 50, best shown in FIGS. 3 and 8. Rearward tab 42 is provided, which engages internal slot 21 of bolt works cylinder 20 in place of forward tab 36 of lock cylinder 32, and provides a connection between bolt works cylinder 20 and camshaft 46. Lost motion connection 50 enables camshaft 46 to be rotated clockwise through a first ninety degree arc without translating motion to bolt works cylinder 20. However, rotation of camshaft 46 through a second ninety degree arc, causes rearward tab 42 to mechanically couple with camshaft 46, which translates rotational movement to bolt works cylinder 20.

Centered within notch 75 is bore 78 which penetrates radially to the interior of ring 74. Pin 80 has a first end 79 and a second end 81, and occupies bore 78 such that it can move freely within the bore. Camshaft 46, assembled within sleeve 54 and ring 74, extends through oblong opening 62 of locking plate 60. First end 79 of pin 80 remains in contact with the outer surface of camshaft 46, and second end 81 touches depending tooth 64. First end 79 begins at a position perpendicular to stop surface 48 relative camshaft 46 as shown in FIGS. 4 and 8, then moves circumferentially about cam surface 47 as camshaft 46 rotates. This rotation forces pin 80 upwardly relative radial bore 78 by cooperation with cam surface 47 until second end 81 of pin 80 forces tooth 64 of locking plate 60 upwardly relative ring 74 as shown in FIG. 7, enabling unimpeded rotation of sleeve 54 and door knob 30 to retract bolt 16.

The user is provided with two alternative methods of unlocking the door: a first method for unlocking the door by use of a key; and a second method for unlocking the door by entry of a combination code. Under the first method, the user inserts a key into keyhole 34. Manual manipulation of the key in the clockwise direction causes rotation of forward tab 36, which in turn rotates camshaft 46. Due to operation of the lost motion connection, the rotation of the key through the first ninety degree arc has no effect on the rearward tab 42. However, rotation of the key through a second ninety degree arc is translated to rearward tab 42, which causes rotation of the bolt works cylinder 20, which withdraws bolt 16.

In a variation of the first method, the user can open the door by a combination of manipulating the key and turning the door knob 30. As described above, rotation of the key through a first ninety degree arc causes rotation of the camshaft 46. As camshaft 46 rotates, an upward force is applied to pin 80, which presses upward onto depending tooth 64, lifting locking plate 60 until tooth 64 comes out of engagement with notch 75. With locking plate 60 disengaged from the interconnecting means, the user can then turn door knob 30 clockwise. Ring 74, sleeve 54 and coupling portion 25 rotate with door knob 30, ultimately causing rotation of bolt works cylinder 20 and withdrawal of bolt 16.

Under the second method of unlocking the door, the user manually enters the proper combination code into the keyboard 86. An electrical signal is generated by known electrical means, which causes actuator 68 to energize and rotate shaft 69 by one revolution. This rotation brings cam 72 into contact with contacting surface 66, lifting it until locking plate 60 has disengaged from the interconnecting means. As described above, the user is then able to turn door knob 30, which rotates ring 74, sleeve 54 and coupling portion 25, ultimately causing rotation of bolt works cylinder 20 and withdrawal of bolt 16.

Under either method of unlocking the door, the internal spring bias of bolt 16 causes it to return to its normally protracted position, and the bolt works cylinder 20 to rotate to its normal position. Sleeve 54 and ring 74 cooperate with the movement of bolt works cylinder 20, and in turn rotate back until depending tooth 64 returns to a position adjacent notch 75. Tooth 64 then re-engages notch 75, with locking plate 60 back in the first locked position, wherein door 10 is one again locked.

Having thus described a preferred exemplary embodiment of an intermediate door locking mechanism, it should now be apparent to those skilled in the art that the aforestated objects and advantages for the within mechanism have been achieved. It should also be appreciated by those skilled in the art that various modifications, adaptations and alternative embodiments thereof may be made within the scope and spirit of the present invention which is defined by the following claims.

I claim:

1. An intermediate locking mechanism for a door interposed between an existing door bolt and an associated door knob having a lock cylinder, said locking mechanism being unlockable by either a key or by entry of a combination code, said locking mechanism comprising:

a camshaft axially connected between said lock cylinder and said door bolt, said camshaft having a cam surface;

a sleeve enclosing said camshaft and axially connecting said door knob to said door bolt;

a ring rigidly surrounding said sleeve, said ring having an external notch and a radial bore centered within said notch;

a movable locking plate having an oblong opening, a radially depending tooth normally positioned to engage said notch, and a contacting surface, said locking plate encompassing said ring within said oblong opening;

a pin having a first end and a second end, said pin being movable within said radial bore, said first end of said pin contacting said cam surface and said second end of said pin contacting said tooth; and an actuator and associated cam adjacent to said contacting surface;

whereby rotation of said key within said lock cylinder rotates said camshaft which urges said pin upwardly relative said ring to disengage said tooth from said notch, enabling unimpeded rotation of said sleeve, and entry of said combination code energizes said actuator causing said cam to engage said contacting surface and manipulate said locking plate upwardly to disengage said tooth from said notch, also enabling unimpeded rotation of said sleeve.

2. The intermediate locking mechanism of claim 1, wherein:

said lock cylinder further comprises an axially connected forward tab; and said camshaft further comprises an axial slot at an end of said camshaft, said forward tab and said slot cooperating together to translate rotation of said key in said lock cylinder to said camshaft.

3. The intermediate locking mechanism of claim 1, further comprising:

a lost motion connection between said camshaft and said door bolt, said lost motion connection enabling rotation of said camshaft through a first ninety degree arc in response to associated rotation of said key without translating said rotational motion to said door bolt, and rotational movement of said camshaft through a second ninety degree arc is translated to said door bolt.

4. The intermediate locking mechanism of claim 1, further comprising a data entry means for manually entering the combination code, said entry means comprising a keyboard and a display screen.

5. The intermediate locking mechanism of claim 1, wherein said-sleeve has a plurality of elongated slits and said ring has a plurality of internal splines that mate with said elongated slits.

6. In a door having a door bolt and an associated door knob, said door knob having an internal lock cylinder and associated key, said lock cylinder having an axially connected forward tab, the improvement being an intermediate locking mechanism which is unlockable by either said key or by entry of combination code, said intermediate locking mechanism comprising:

a camshaft having a cam surface, a lost motion connection to said door bolt, and an axial slot, said forward tab mating with said slot to translate rotation of said key in said lock cylinder to said camshaft;

a sleeve enclosing said camshaft and axially connecting said door knob to said door bolt;

a ring rigidly surrounding said sleeve, said ring having an external notch and a radial bore centered within said notch;

a movable locking plate having an oblong opening, a radially depending tooth normally positioned to engage said notch, and a contacting surface, said locking plate encompassing said ring within said oblong opening;

a pin having a first end and a second end, said pin being movable within said radial bore, said first end of said pin contacting said cam surface and said second end of said pin contacting said tooth; and an actuator and associated cam adjacent to said contacting surface;

whereby rotation of said key within said lock cylinder rotates said camshaft which urges said pin upwardly relative said ring to disengage said tooth from said notch, enabling unimpeded rotation of said sleeve, and entry of said combination code energizes said actuator causing said cam to engage said contacting surface and manipulate said locking plate upwardly to disengage said tooth from said notch, also enabling unimpeded rotation of said sleeve.

7. The intermediate locking mechanism of claim 6, further comprising:

a data entry means for manually entering the combination code, said entry means comprising a keyboard and a display screen.

8. The intermediate locking mechanism of claim 6, wherein said sleeve has a plurality of elongated slits and said ring has a plurality of internal splines that mate with said elongated slits.

9. The intermediate locking mechanism of claim 6, further comprising:

a lost motion connection between said camshaft and said door bolt, said lost motion connection enabling rotation of said camshaft through a first ninety degree arc in response to associated rotation of said key without translating said rotational motion to said door bolt, and rotational movement of said camshaft through a second ninety degree arc is translated to said door bolt.

10. An intermediate locking mechanism for a door interposed between an exiting door bolt and an associated door knob, comprising:

interconnecting means for interconnecting said door knob to said door bolt within which manipulation of said door knob withdraws said door bolt;

securing means for securing said interconnecting means to preclude its manipulation;

electrically operated means for unlocking said securing means by entry of an electronically entered combination code; and mechanical key operated means or alternatively unlocking said securing means by manipulation of a key wherein said interconnecting means further comprises a sleeve axially connecting said door knob to said door bolt, and a ring rigidly surrounding a portion of said sleeve, said ring having an external notch, wherein said securing means further comprises: a movable locking plate having an oblong opening, a radially depending tooth normally positioned to engage said notch, and a contacting surface, said locking plate encompassing said ring within said oblong opening.

11. The intermediate locking mechanism of claim 10, wherein said sleeve has a plurality of elongated slits and said ring has a plurality of internal splines that mate with said elongated slits.

12. The intermediate locking mechanism of claim 10, wherein said electrically operated means further comprises:

a data entry means for manually entering the combination code, and an actuator and associated cam adjacent to said contacting surface, said cam being rotatable in response to entry of said combination code into said entry means to engage said contacting surface and manipulate said locking plate until said tooth has disengaged from said notch, enabling unimpeded rotation of said interconnecting means.

13. The intermediate locking mechanism of claim 12, wherein said entry means further comprises a keyboard and a display screen.

14. The intermediate locking mechanism of claim 12, wherein said mechanical key operated means further comprises:

a lock cylinder operable by said key and positioned internal of said door knob, a camshaft within said sleeve axially connected between said lock cylinder and said door bolt, a pin having a first end and a second end, and a radial bore centered within said notch, said pin being movable within said radial bore, said camshaft having a cam surface, said first end of said pin contacting said cam surface and said second end of said pin contacting said tooth;

whereby rotation of said key within said lock cylinder further causes rotation of said camshaft which urges said pin upwardly relative said ring, until said tooth has disengaged from said notch, enabling unimpeded rotation of said interconnecting means.

15. The intermediate locking mechanism of claim 14, wherein said mechanically operated means further comprises:

a lost motion connection between said camshaft and said door bolt, said lost motion connection enabling rotation of said camshaft through a first ninety degree arc in response to associated rotation of said key without translating said rotational motion to said door bolt and rotational movement of said camshaft through a second ninety degree arc is translated to said door bolt.

16. The intermediate lock mechanism of claim 14, wherein said lock cylinder has an axially connected forward tab, and said camshaft has an axial slot at one end, said forward tab and said slot cooperating together to translate rotation of said key in said lock cylinder to said camshaft.

17. An intermediate locking mechanism for a door interposed between an existing door bolt and an associated door knob, comprising:

interconnecting means for interconnecting said door knob to said door bolt with which manipulation of said door knob withdraws said door bolt, said interconnecting means comprising a sleeve axially connecting said door knob to said door bolt, and a ring rigidly surrounding said sleeve and having an external notch;

securing means for securing said interconnecting means to preclude its manipulation, said securing means comprising a movable locking plate having an oblong opening, a radially depending tooth normally positioned to engage said notch, and a contacting surface, said locking plate encompassing said ring within said oblong opening;

electrically operated means for unlocking said securing means by entry of a combination code, said electrically operated means comprising a data entry means for manually entering the combination code, and an actuator and associated cam adjacent to said contacting surface, said cam being rotatable in response to entry of said combination code into said entry means to engage said contacting surface and manipulate said locking plate upwardly until said tooth has disengaged from said notch, enabling unimpeded rotation of said interconnecting means; and mechanical key operated means for unlocking said securing means by manipulation of a key, said mechanically operated means comprising a lock cylinder operable by said key and positioned internal of said door knob, a camshaft within said sleeve and axially connected between said lock cylinder and said door bolt, and a radial bore centered within said notch, and a pin having a first end and a second end, said pin being movable within said radial bore, said camshaft having a cam surface, said first end of said pin contacting said cam surface and said second end of said pin contacting said tooth, whereby rotation of said key within said lock cylinder further rotates said camshaft which urges said pin upwardly relative said ring, until said tooth has disengaged from said notch, enabling unimpeded rotation of said interconnecting means.

18. The intermediate locking mechanism of claim 17, wherein said sleeve has a plurality of elongated slits and said ring has a plurality of internal splines that mate with said elongated slits.

19. The intermediate locking mechanism of claim 17, wherein said entry means further comprises a keyboard and a display screen.

20. The intermediate locking mechanism of claim 17, wherein said mechanically operated means further comprises:

a lost motion connection between said camshaft and said door bolt, said lots motion connection enabling rotation of said camshaft through a first ninety degree arc in response to associated rotation of said key without translating said rotational motion to said door bolt, and rotational movement of said camshaft through a second ninety degree arc is translated to said door bolt.

21. The intermediate locking mechanism of claim 17, wherein said lock cylinder has an axially connected forward tab, and said camshaft has an axial slot at one end, said forward tab and said slot cooperating together to translate rotation of said key in said lock cylinder to said camshaft.

* * * * *